US005611156A

United States Patent [19]

Chiu

[11] Patent Number: 5,611,156

[45] Date of Patent: Mar. 18, 1997

[54] REFLECTIVE SHOE

[76] Inventor: Chang H. Chiu, 16912 Gothard St., Unit 1, Huntington Beach, Calif. 92647

[21] Appl. No.: 426,574

[22] Filed: Apr. 21, 1995

[51] Int. Cl.[6] ..... A43B 23/00

[52] U.S. Cl. ..... 36/137; 36/100; 36/57

[58] Field of Search ..... 36/137, 57, 58, 36/100, 136

[56] References Cited

U.S. PATENT DOCUMENTS

| | | | |
|---|---|---|---|
| 2,180,076 | 11/1939 | Swartz | 36/57 |
| 2,233,544 | 3/1941 | McKinley | 88/80 |
| 2,299,316 | 10/1942 | Fein | 36/57 |
| 2,473,877 | 6/1949 | Goldstein | 250/71 |
| 2,607,130 | 8/1952 | Pearson | 36/1 |
| 3,527,518 | 9/1970 | Tomlison et al. | 350/98 |
| 3,994,080 | 11/1976 | Flanagan, Jr. et al. | 36/100 |
| 4,188,737 | 2/1980 | Haver | 36/131 |
| 4,233,760 | 11/1980 | Haynes | 36/137 |
| 4,651,447 | 3/1987 | Sullivan | 36/137 |
| 4,712,319 | 12/1987 | Goria | 36/137 |
| 5,136,726 | 8/1992 | Kellin et al. | 36/136 |
| 5,220,791 | 6/1993 | Bulzomi | 36/3 A X |
| 5,379,533 | 1/1995 | Swartz | 36/136 |

FOREIGN PATENT DOCUMENTS

| | | | |
|---|---|---|---|
| 957102 | 1/1957 | Germany | 36/137 |
| 3280901 | 12/1991 | Japan | 36/137 |

*Primary Examiner*—Ted Kavanaugh

*Attorney, Agent, or Firm*—Sheldon & Mak; Denton L. Anderson; Otto O. Lee

[57] ABSTRACT

A shoe having reflective surfaces between a covering layer and an underlying layer.

2 Claims, 1 Drawing Sheet

REFLECTIVE SHOE

FIELD OF THE INVENTION

This invention relates generally to shoes and specifically relates to shoes having reflective surfaces.

BACKGROUND OF THE INVENTION

Reflective material is commonly used to enhance night visibility of footwear. Typically, large strips of reflective material are attached directly onto the surface of the shoe with glue or stitches. Thus the reflective surface is wholly exposed.

Various problems exist with such simple designs, however. Such designs are undesirable because they require the use of excessive reflective material which is expensive. The construction also requires the use of a fastening means comprising either an adhesive material on the back of the reflective material, or stitches along the edges of the reflective material. Because of this construction, the reflective material is frequently loosened upon normal wear and tear or upon exposure to heat or moisture. Finally, this arrangement presents a less than pleasing aesthetic appearance because the large strips of reflective material cover the shoe surface and thereby interfere and obstruct the perspective design and outline of the shoe.

Accordingly, there is a need for a shoe with strong and durable construction that provides a reflective visibility at night, while using less of the expensive reflective material, and at the same time presents an enhanced aesthetic appearance without significantly covering the shoe surface and/or changing the design of the shoe.

SUMMARY OF THE INVENTION

The invention satisfies this need. The invention comprises a shoe with a sole and sides attached to the sole. The sides have a covering layer, which at least partially overlaps an underlying layer. A reflective material layer having at least one surface with reflective characteristics is disposed between the covering and the underlying layers in such a way that the reflective material layer is at least partially visible from an external perspective.

In one embodiment, the reflective material layer is visible through one or more apertures in the covering layer.

In another embodiment, the reflective material layer protrudes under the covering layer by a strip to overlap the underlying layer.

In still another embodiment, the reflective material layer is substantially disposed along a welt between the sides and the sole.

In another embodiment, the covering layer is a toe cap.

In another embodiment, the covering layer is an eyelet tab.

In another embodiment, the covering layer is a tongue.

In another embodiment, the covering layer is an outside counter.

In another embodiment, the covering layer is a cuff.

In another embodiment, the reflective material layer is substantially aligned around at least an eyelet.

In another embodiment, the covering layer is an ankle strap.

In another embodiment, the reflective layer is removably attached between the covering and the underlying layers. In another preferred version of this embodiment, the reflective layer is removably attached with hook and loop fasteners between the covering and the underlying layers.

In another embodiment, the reflective material layer is wrapped around a wire that is disposed along an edge of the sides of the shoe, so that the reflective material has a strengthened structure along the edge of the shoe.

In another embodiment, the reflective shoe has a reflective shoelace.

Therefore the invention satisfies the long felt need of a shoe having durable reflective surfaces which do not interfere or obstruct the general outline or design of the shoe.

DESCRIPTION OF THE DRAWINGS

These and other features, aspects, and advantages of the present invention will become better understood from the following description, appended claims, and accompanying drawings, where:

DETAILED DESCRIPTION OF THE INVENTION

Figure 1:
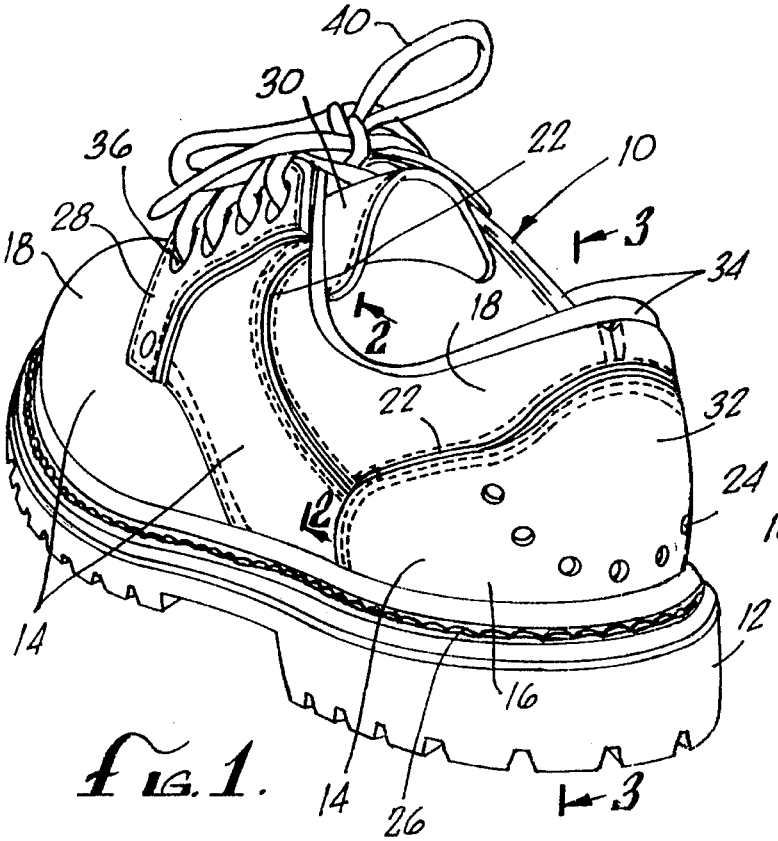
FIG. 1 is a perspective view of a reflective shoe having features of the invention.

The following discussion describes in detail one embodiment of the invention and several variations of that embodiment. This discussion should not be construed, however, as limiting the invention to those particular embodiments. Practitioners skilled in the art will recognize numerous other embodiments as well. For a definition of the complete scope of the invention, the reader is directed to the appended claims.

As shown in the drawings, the invention is a reflective shoe 10.

The reflective shoe 10 comprises a sole 12, and sides 14 attached to the sole 12. The sides 14 are comprised of a covering layer 16 and an underlying layer 18. The covering layer 16 at least partially overlaps the underlying layer 18. A reflective material layer 20 is disposed between the covering layer 16 and the underlying layer 18 in such a way that the reflective material layer 20 is at least partially visible from an external perspective.

Typically, the reflective material 20 is made of retroreflective fabric which has approximately 50,000 minute glass beads to the square inch which reflect incoming light beams. Such material can be the commercially available RETROGLO® material manufactured by Metlon Corporation of Cranston, R.I. This retroreflective fabric reflects light back to the light source, and has reflective surfaces on one or both sides of the fabric.

In a preferred embodiment, the reflective material layer 20 protrudes under the covering layer 16 by a strip 22 that overlaps the underlying layer 18. Typically the strip 22 will be of approximately ⅛ to ¼ of an inch in width such that it is visible to an outside perspective, without obstructing the perspective design or outline of the reflective shoe 10.

Figure 3:
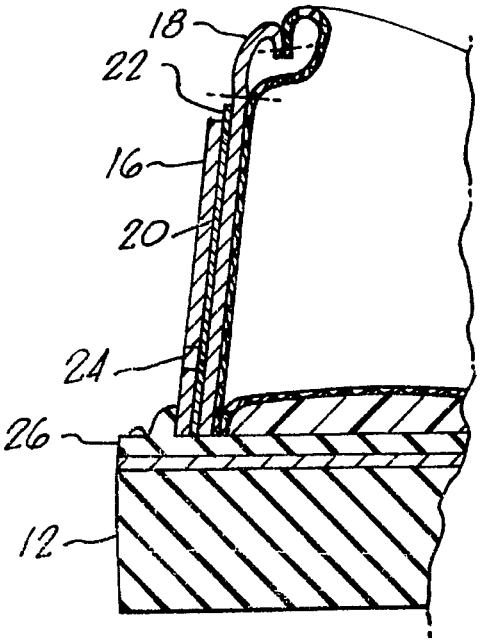
FIG. 3 is a cross-sectional view of the rear portion of the reflective shoe of FIG. 1 taken along line 3—3.

As shown in FIG. 3, in one embodiment, one or more apertures 24 are made in the covering layer 16 such that the reflective material is visible through the apertures 24.

In another embodiment, the reflective material layer 20 is disposed along a welt 26 between the sides 14 and the sole 12, so as to form a reflective effect which displays the outline of the reflective shoe 10.

In another embodiment, the reflective material layer 20 is disposed between the covering and underlying layers around an eyelet tab 28, so as to form a reflective effect which displays the outline of the eyelet tab 28.

In another embodiment, the reflective material layer 20 is disposed between the covering and underlying layers around a tongue 30, so as to form a reflective effect which displays the outline of the tongue 30.

In another embodiment, the reflective material layer 20 is disposed between the covering and underlying layers around an outside counter 32, so as to form a reflective effect which displays the outline of the outside counter 32.

In another preferred embodiment, the reflective material layer 20 is disposed between the covering and underlying layers around a cuff 34, so as to form a reflective effect which displays the outline of the cuff 34.

In another embodiment, the reflective material layer 20 is disposed around an eyelet, so as to form a reflective effect which displays the outline of the eyelet 36.

Figure 4:
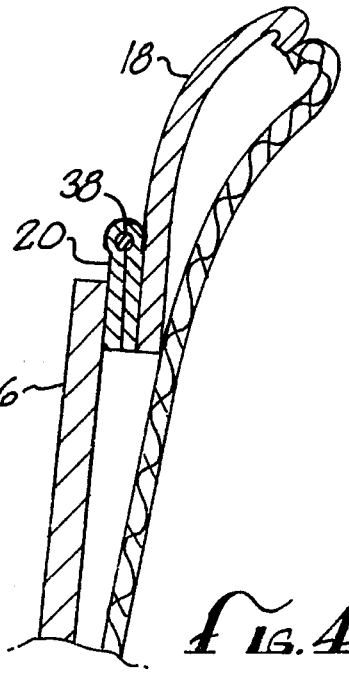
FIG. 4 is a detailed cross-sectional view of an embodiment of the invention wherein the reflective material is wrapped around a wire.
Figure 2:
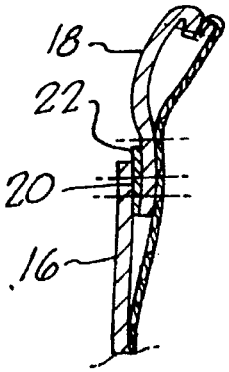
FIG. 2 is a cross-sectional view of the surface of the reflective shoe of FIG. 1 taken along line 2—2.

As shown in FIG. 4, in another embodiment, the reflective material layer 20 is wrapped around a wire 38 and the wire 38 is disposed along an edge of the sides 14 of the reflective shoe 10. Preferably, the wire 38 is made of a stiff, strong and flexible material such as a metal, having a diameter of approximately 1/64 to 1/32 of an inch. Typically, attaching means such as thread stitches, or adhesives are used to ensure that the reflective material is firmly wrapped around the wire 38.

The reflective layer 20 may also be removably disposed between the covering layer 16 and the underlying layer 18. In a preferred embodiment, the reflective material layer 20 is attached to the covering layer 16 and the underlying layer 18 by a multiple of hook and loop fasteners, such as the common VELCRO® material (not shown). Preferably, the inner surface of the covering layer 16 and the underlying layer 18 are attached with the hook fasteners, while the reflective material layer 20 is attached with the loop fasteners on one or both sides. This arrangement will allow the interchangeability of the reflective material layer 20 of different designs or colors.

In still another embodiment, the reflective shoe is laced with a reflective shoelace 40.

Therefore the features taught by this invention satisfy the need of a shoe having durable reflective surfaces, without interfering or obstructing the general outline or design of the shoe, thereby resulting in a more aesthetically pleasing appearance.

Although the present invention has been described in considerable detail with reference to certain preferred versions thereof, numerous structural modifications and adaptations may be resorted to without departing from the scope and fair meaning of the instant invention as set forth hereinabove. Therefore, the spirit and scope of the appended claims should not be limited to the description of preferred versions contained herein.

What is claimed is:

1. A shoe comprising:

(a) a sole;

(b) sides attached to the sole, wherein the sides are comprised of a covering layer and an underlying layer, and wherein the covering layer at least partially overlaps the underlying layer; and (c) a reflective material layer having at least one surface with reflective characteristics;

wherein the reflective material layer is disposed between the covering and the underlying layers in such a way that the reflective material layer is at least partially visible from an external perspective;

wherein the reflective material layer is wrapped around a wire, and wherein the wire is disposed along an edge of the shoe.

2. A shoe comprising:

(a) a sole;

(b) sides attached to the sole, the sides including a covering layer and an underlying layer, wherein the covering layer at least partially overlaps the underlying layer;

(c) a reflective material layer, wherein the reflective material layer has at least one surface with reflective characteristics; and (d) a metal wire;

wherein the reflective material layer wraps around the metal wire and is disposed between the covering and the underlying layers, such that the reflective material layer is at least partially visible from an outside perspective.

* * * * *